US007000420B2

(12) United States Patent
Ahn et al.

(10) Patent No.: US 7,000,420 B2
(45) Date of Patent: Feb. 21, 2006

(54) COMPRESSOR

(75) Inventors: Hew Nam Ahn, Daejeon (KR); Min Joo Lee, Daejeon (KR); Hak Soo Kim, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 0 days.

(21) Appl. No.: 10/648,250

(22) Filed: Aug. 27, 2003

(65) Prior Publication Data

US 2004/0040331 A1 Mar. 4, 2004

(30) Foreign Application Priority Data

Aug. 29, 2002 (KR) ..... 10-2002-0051500

(51) Int. Cl.
*F04B 53/00* (2006.01)

(52) U.S. Cl. ..... 62/296; 181/403; 417/312

(58) Field of Classification Search ..... 62/296; 417/312; 181/403
See application file for complete search history.

(56) References Cited

U.S. PATENT DOCUMENTS 4,930,995 A * 6/1990 Suzuki et al. ..... 417/312
5,112,198 A 5/1992 Skinner
5,507,627 A 4/1996 Okazaki
5,556,260 A 9/1996 Takenaka et al.
5,645,405 A * 7/1997 Ota et al. ..... 417/269
5,782,614 A * 7/1998 Shimizu et al. ..... 417/269
6,386,846 B1 * 5/2002 Murase et al. ..... 417/540
6,402,483 B1 * 6/2002 Kawamura et al. ..... 417/269
6,488,481 B1 * 12/2002 Nagai et al. ..... 417/312
6,568,914 B1 5/2003 Ahn ..... 417/222.2
6,568,920 B1 * 5/2003 Yttri et al. ..... 417/312

* cited by examiner

*Primary Examiner*—William E. Tapolcai
(74) *Attorney, Agent, or Firm*—Lowe Hauptman & Berner, LLP

(57) ABSTRACT

A compressor that sucks refrigerant gas from an external refrigerant circuit, compresses the sucked refrigerant gas and discharges the compressed refrigerant gas, comprising a cylinder having a plurality of bores, a front housing coupled to the front side of the cylinder and forming a crank chamber, a driving shaft supported so as to freely rotate with respect to the cylinder and the front housing, a single-headed piston connected to a slanting plate element mounted on the driving shaft and linearly reciprocating inside the bores of the cylinder, and a rear housing coupled to and closing the rear side of the cylinder. In the compressor, the rear housing comprises a discharge chamber provided at the center of the interior of the rear housing, so that the refrigerant gas discharged from the cylinder remains in the discharge chamber before being discharged to the external refrigerant circuit, a suction chamber provided so as to surround the discharge chamber, so that refrigerant gas sucked from the external refrigerant circuit remains in the suction chamber before being moved to the cylinder, and a pulsation pressure reduction conduit provided at the rear side of the rear housing, having an inlet led to the discharge chamber and an outlet led to the external refrigerant circuit, and extending in a radial direction of the rear housing, and wherein the inlet of the pulsation pressure reduction conduit through which the discharged gas of the discharge chamber passes is positioned at a distance at which the pressure pulsations of the discharged gas at the respective discharge holes are substantially equal.

5 Claims, 6 Drawing Sheets

COMPRESSOR

BACKGROUND OF THE INVENTION

1. Field of the Invention

The present invention relates to a compressor used for an air conditioning system for a vehicle, and more particularly to a single-headed piston type compressor having a structure of reducing the pulsation pressure of discharged gas.

2. Description of the Related Art

In general, in an air conditioning system for a vehicle, noises are generated due to pressure pulsation of sucked or discharged gas. In order to reduce a noise generated due to pressure pulsation of the discharged gas, conventionally, a separate discharge muffler chamber has been provided on the outer circumferential surface of a compressor. In this case, however, the overall volume of the compressor is undesirably increased, so that the compressor cannot be suitably used for vehicles which require a small, lightweight compressor. Also, in this case, it is necessary to install a connecting passage that connects a discharge chamber inside a rear housing with a discharge muffler chamber provided on the outer circumferential surface of the compressor. Thus, as the length of the passage increases, a reduction in the amount of compressed refrigerant is increased, thereby lowering the performance of the compressor.

To overcome the above-described problem, there has been proposed a compressor, as shown in FIGS. 1 and 2 in which only a suction muffler chamber 6 connected to an external refrigerant circuit through a suction port 6*a* is formed on the outer circumferential surface of a cylinder 2, but a discharge muffler chamber is not formed. Here, refrigerant gas of a discharge chamber 7 is discharged through a discharge pipe 3 formed in the rear portion of a rear housing 1. In this case, since distances L1~L6 (FIG. 2) between discharge holes 8 each connecting the cylinder 2 with the discharge chamber 7 and an inlet 3*a* of the discharge pipe 3 are different, pressure pulsation of the refrigerant gas discharged at each of the respective discharge holes 8 is different from the pressure pulsation of the refrigerant gas discharged at the inlet 3*a* of the discharge pipe 3. Thus, the overall pressure pulsation is not reduced.

To solve the above-described problem, as disclosed in U.S. Pat. No. 6,568,914 to the applicant of the present invention, at least two discharge holes are formed at a discharge pipe so as to allow a predetermined phase difference at a position where refrigerants induced to a discharge pipe passage through the two discharge holes, meet, thereby minimizing an increase in pulsation pressure. In order to allow a predetermined phase difference between the respective refrigerants induced to a discharge pipe passage through the two discharge holes, the number, size, and position of each of the discharge holes should be determined theoretically or by a trial-error method, which is, however, not easy to carry out in practice.

SUMMARY OF THE INVENTION

The present invention provides a compressor which can reduce pressure pulsation of discharged gas and noise due to the pressure pulsation, while maintaining the overall volume of the compressor.

The present invention also provides a compressor which can reduce pressure pulsation of discharged gas and noise due to the pressure pulsation, while reducing a pressure drop in compressed refrigerant discharged from the compressor.

The present invention also provides a compressor which can reduce pressure pulsation of discharged gas and noise due to the pressure pulsation, while maintaining a space occupied by a discharge chamber inside a rear housing of the compressor.

In an aspect of the present invention, there is provided a compressor that sucks refrigerant gas from an external refrigerant circuit, compresses the sucked refrigerant gas and discharges the compressed refrigerant gas, comprising a cylinder having a plurality of bores, a front housing coupled to the front side of the cylinder and forming a crank chamber, a driving shaft supported so as to freely rotate with respect to the cylinder and the front housing, a single-headed piston connected to a slanting plate element mounted on the driving shaft and linearly reciprocating inside the bores of the cylinder, and a rear housing coupled to and closing the rear side of the cylinder, the compressor wherein the rear housing comprises a discharge chamber provided at the center of the interior of the rear housing, so that the refrigerant gas discharged from the cylinder remains in the discharge chamber before being discharged to the external refrigerant circuit, a suction chamber provided so as to surround the discharge chamber, so that refrigerant gas sucked from the external refrigerant circuit remains in the suction chamber before being moved to the cylinder, and a pulsation pressure reduction conduit provided at the rear side of the rear housing, having an inlet led to the discharge chamber and an outlet led to the external refrigerant circuit, and extending in a radial direction of the rear housing, and wherein the inlet of the pulsation pressure reduction conduit through which the discharged gas of the discharge chamber passes is positioned at a distance at which the pressure pulsations of the discharged gas at the respective discharge holes are substantially equal.

Preferably, the inlet of the pulsation pressure reduction conduit is equally spaced from the discharge holes through which the gas discharged from the cylinder to the discharge chamber passes.

Also, the inlet of the pulsation pressure reduction conduit is preferably positioned at the center of the discharge chamber.

A cross-sectional area of the inlet of the pulsation pressure reduction conduit may be determined by a cross-sectional area of a passageway of the pulsation pressure reduction conduit such that the pulsation pressure of the discharged gas at the passageway of the pulsation pressure reduction conduit is smaller than the pulsation pressure of the discharged gas at the inlet of the pulsation pressure reduction conduit.

A cross-sectional area of the inlet of the pulsation pressure reduction conduit is preferably smaller than a cross-sectional area of a passageway of the pulsation pressure reduction conduit.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
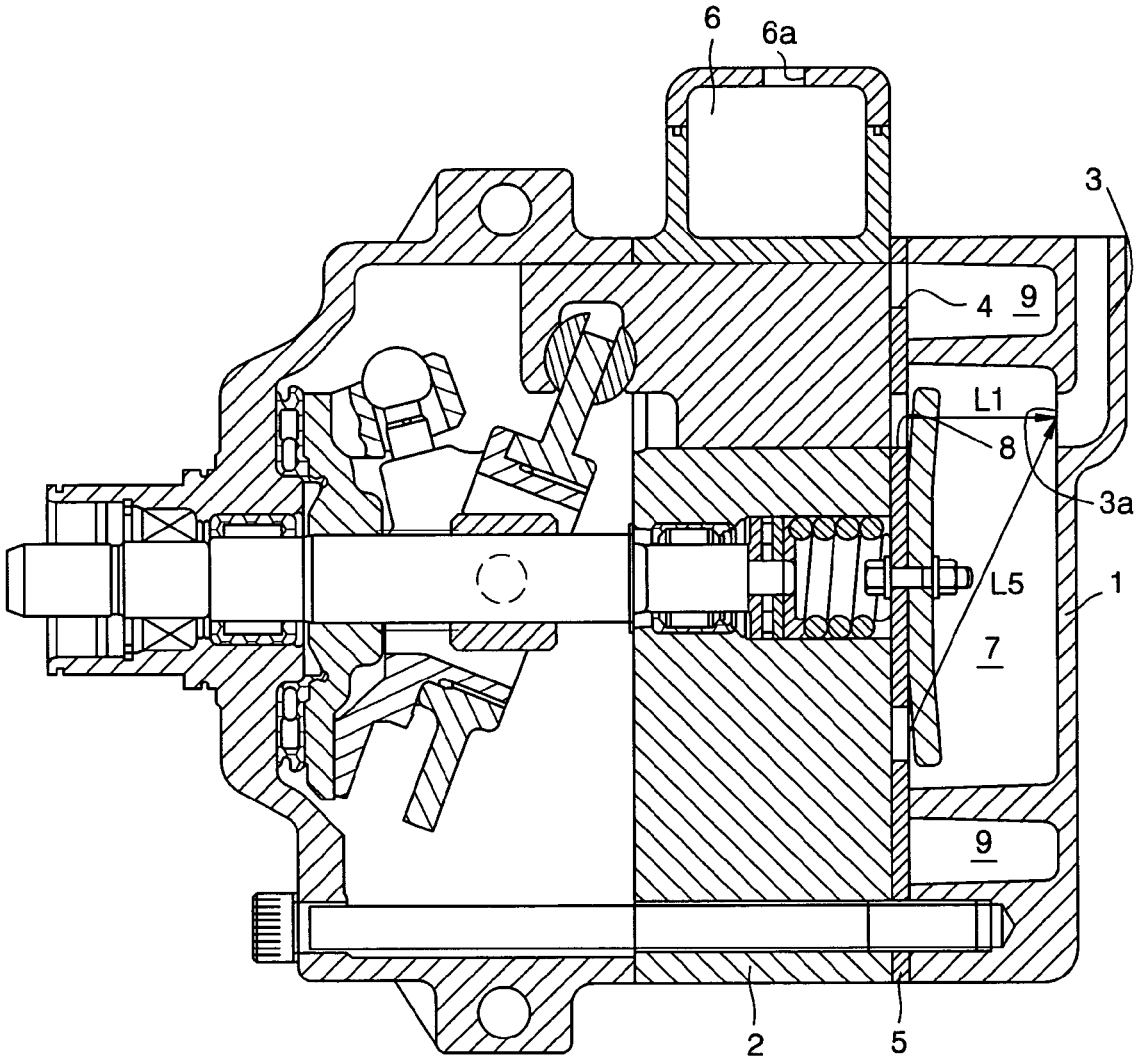
FIG. 1 (PRIOR ART)
FIG. 1 is a cross-sectional view of a conventional compressor.
Figure 2:
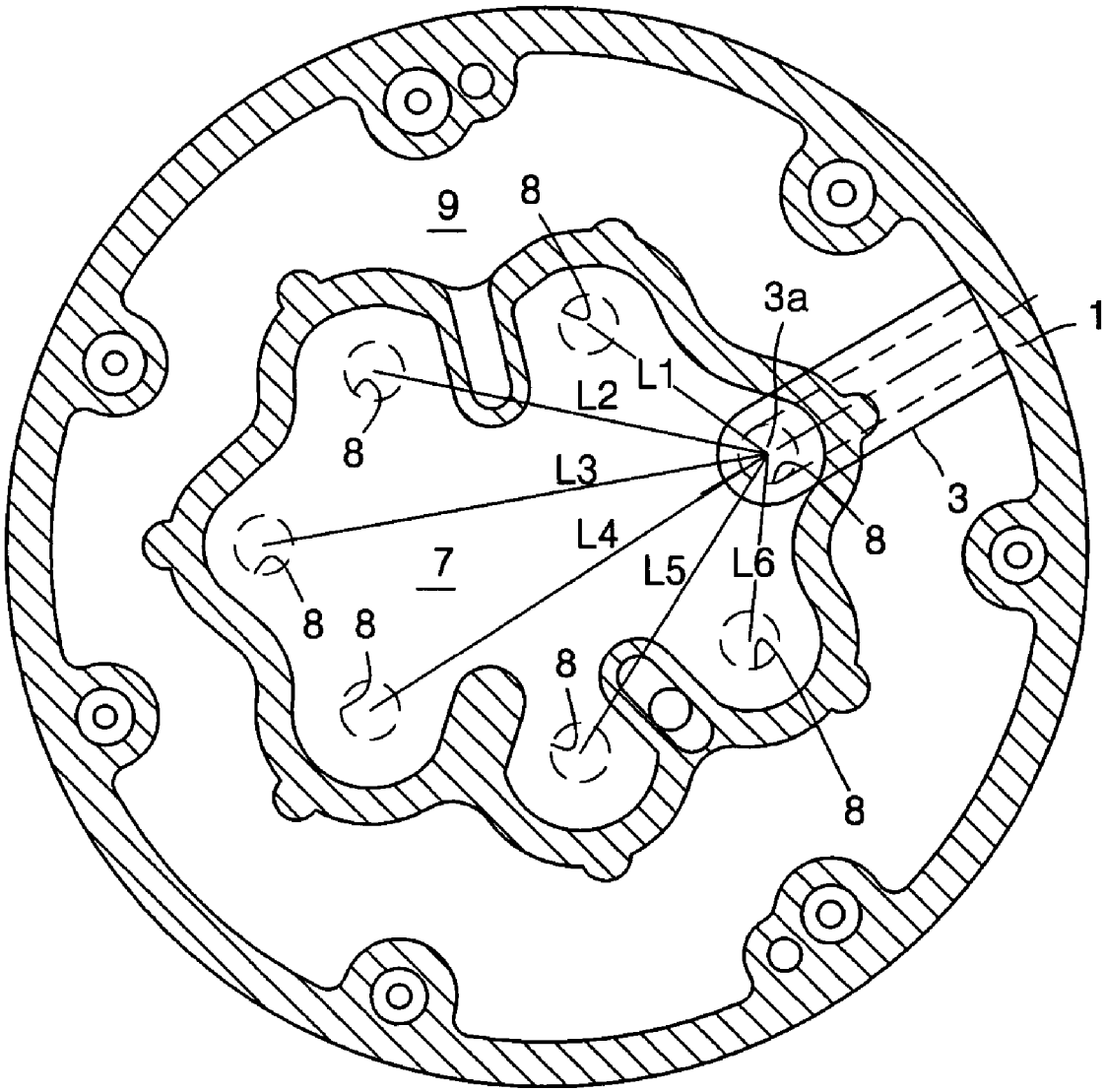
FIG. 2 (PRIOR ART)
FIG. 2 illustrates a rear housing of the compressor shown in FIG. 1.
Figure 3:
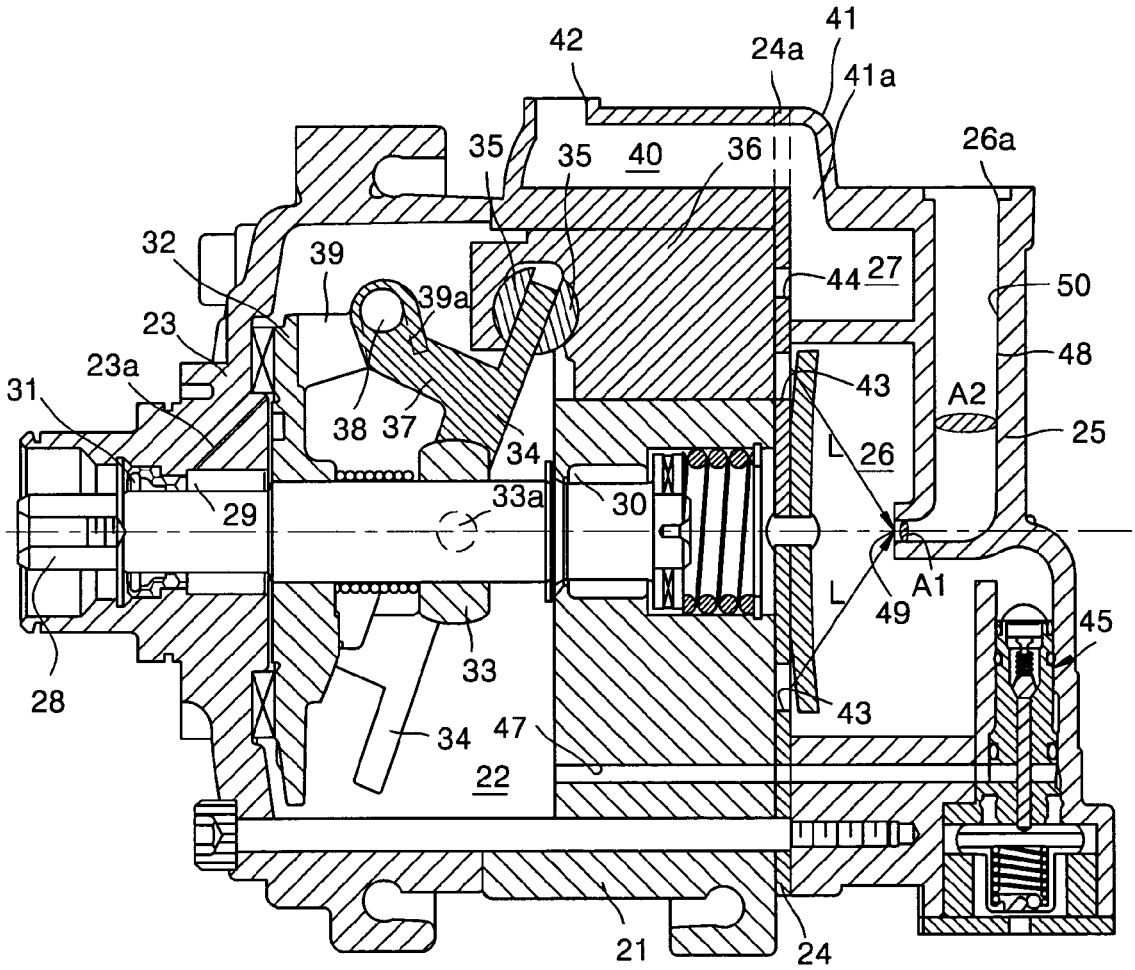
FIG. 3 is a cross-sectional view of a compressor according to the present invention.

Referring to FIG. 3, a cylinder 21 has at least five bores. The front side of the cylinder 21 is closed by a front housing 23 having a crank chamber 22, and the rear side of the cylinder 21 is closed by a rear housing 25 having a discharge chamber 26 and a suction chamber 27. The discharge chamber 26 is disposed at the center of the interior of the rear housing 25, so that the refrigerant gas discharged from the cylinder 21 remains in the discharge chamber 26 before being discharged to the external refrigerant circuit. The suction chamber 27 is provided so as to surround the discharge chamber 26 in the interior of the rear housing 25. A valve plate 24 having discharge holes 43 and suction holes 44 therethrough is positioned between the cylinder 21 and the rear housing.

By providing the discharge chamber 26 at the interior side of the cylinder 21, as described above, an integrated valve assembly having a radial arrangement, that is, a discharge lead valve (not shown) can be compactly configured.

A shaft sealing device 31 is installed at an extending portion of the front housing side of a driving shaft 28. The driving shaft 28 is supported on the front housing 23 and the cylinder 21 by radial shaft supports 29 and 30. A rotor 32 is fittingly fixed to the driving shaft 28 inside the crank chamber 22 to transfer rotation of the driving shaft 28 to a swash plate 34. The rotor 32 is rotatably supported on the inner surface of the front housing 23.

A sleeve 33 is fitted to the driving shaft 28 so as to be capable of sliding.

Pivots 33*a* protrude at opposite sides of the sleeve 33, and the pivots 33*a* are fitted into holes formed at the swash plate 34 so that the swash plate 34 is capable of rotating in a slanting state.

Flat planes of a pair of hemispherical shoes 35 are contacted at the front and rear sides of a sliding plane of the swash plate 34 respectively so that they are capable of facing each other. Spherical planes of the hemispherical shoes 35 are spherically contacted inside a hole formed at the single-headed piston 36 inserted into each bore, allowing the single-headed piston 36 to lie in the swash plate 34.

A pair of hub arms 37 of a hinge mechanism extend along the top dead center of the swash plate 34 at the front surface of the swash plate 34, and a guide pin 38 penetrating and engaged to each of the hub arms 37 and the rotor 32 is fitted in the hub arm 37 and the rotor 32.

Also, a pair of support arms 39 of the hinge mechanism are installed at the rear surface of the rotor 32 and the guide pin 38 is fitted into a hole 39*a* passing through each support arm 39, thereby regulating movement of the swash plate 34. The hole 39*a* of each of the support arms 39 has a predetermined central inclination angle so that the top portion of the single-headed piston 36 is maintained at a secured position.

The rotor 32, the sleeve 33 and the swash plate 34 form a slanting plate that represents a characteristic feature of the present invention.

Reference numeral 45 denotes a capacity volume control valve for controlling the capacity of refrigerant gas inside the crank chamber 22. The capacity volume control valve 45 connects the crank chamber 22 with a capacity control passageway 47.

At the rear side of the rear housing, there is provided a pulsation pressure reduction conduit 48 through which gas discharged from the discharge chamber 26 to the external refrigerant circuit passes. An inlet 49 of the pulsation pressure reduction conduit 48 is positioned at an equal distance from the respective discharge holes 43 penetrating the valve plate 24, the respective discharge holes 43 through which gas discharged from the cylinder 21 to the discharge chamber 26 passes.

Figure 4:
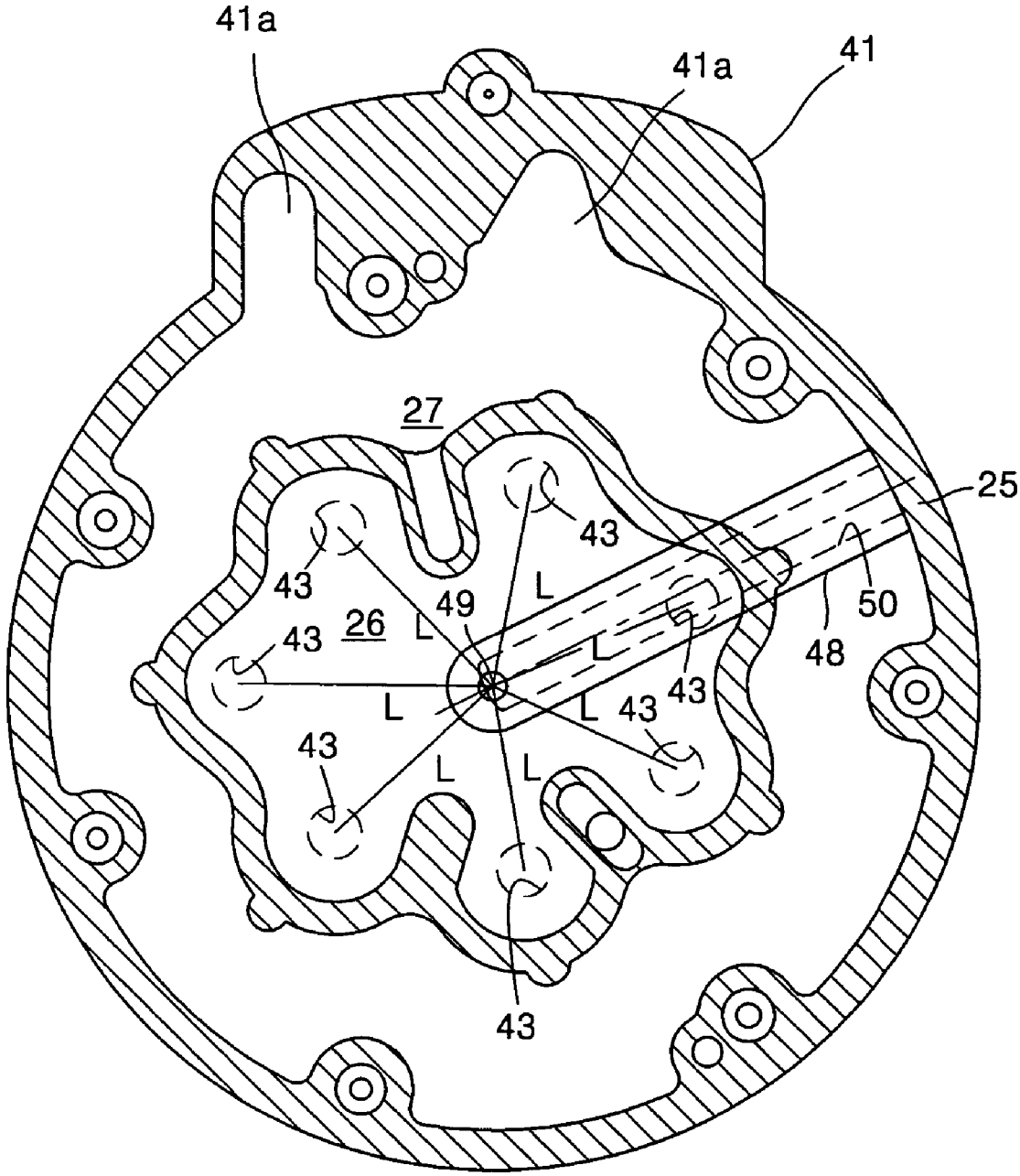
FIG. 4 illustrates a rear housing of the compressor shown in FIG. 3.

For example, as shown in FIG. 4, the inlet 49 of the pulsation pressure reduction conduit 48 is preferably positioned at the center of the discharge chamber 26. Accordingly, distances L between the respective discharge holes 43, through which the gas discharged from the cylinder 21 to the discharge chamber 26 passes, and the inlet 49 of the pulsation pressure reduction conduit 48 are equal to one another, as shown in FIG. 4. Thus, the pressure pulsation of the discharged gas generated at each of the respective discharge holes 43 becomes substantially the same as that generated at the inlet 49 of the pulsation pressure reduction conduit 48, thereby substantially reducing the overall pressure pulsation of the discharged gas at the inlet 49 of the pulsation pressure reduction conduit 48.

Figure 5A:
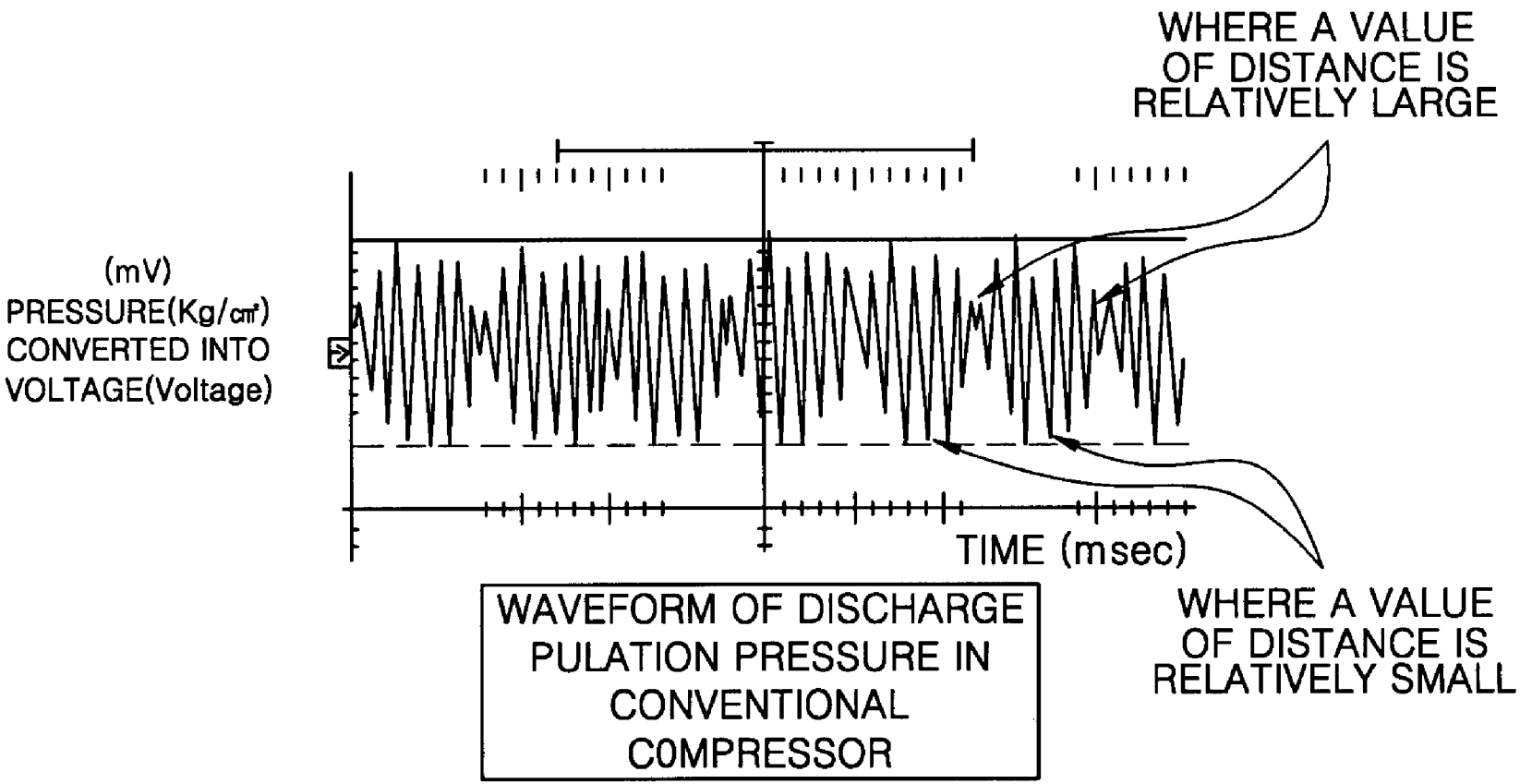
FIG. 5A (PRIOR ART)
FIG. 5A is a graph showing the waveforms of pressure pulsation of refrigerant discharged in the conventional compressor.

Conventionally, however, as shown in FIG. 5A, distances between the respective discharge holes 43 and the inlet 49 of the pulsation pressure reduction conduit 48 are not equal to one another. Thus, if a value of the distance is relatively small, the amplitude of discharge pressure pulsation is increased, and if a value of the distance is relatively large, the amplitude of discharge pressure pulsation is decreased. As a result, the overall amplitude of discharge pressure pulsation is increased.

Figure 5B:
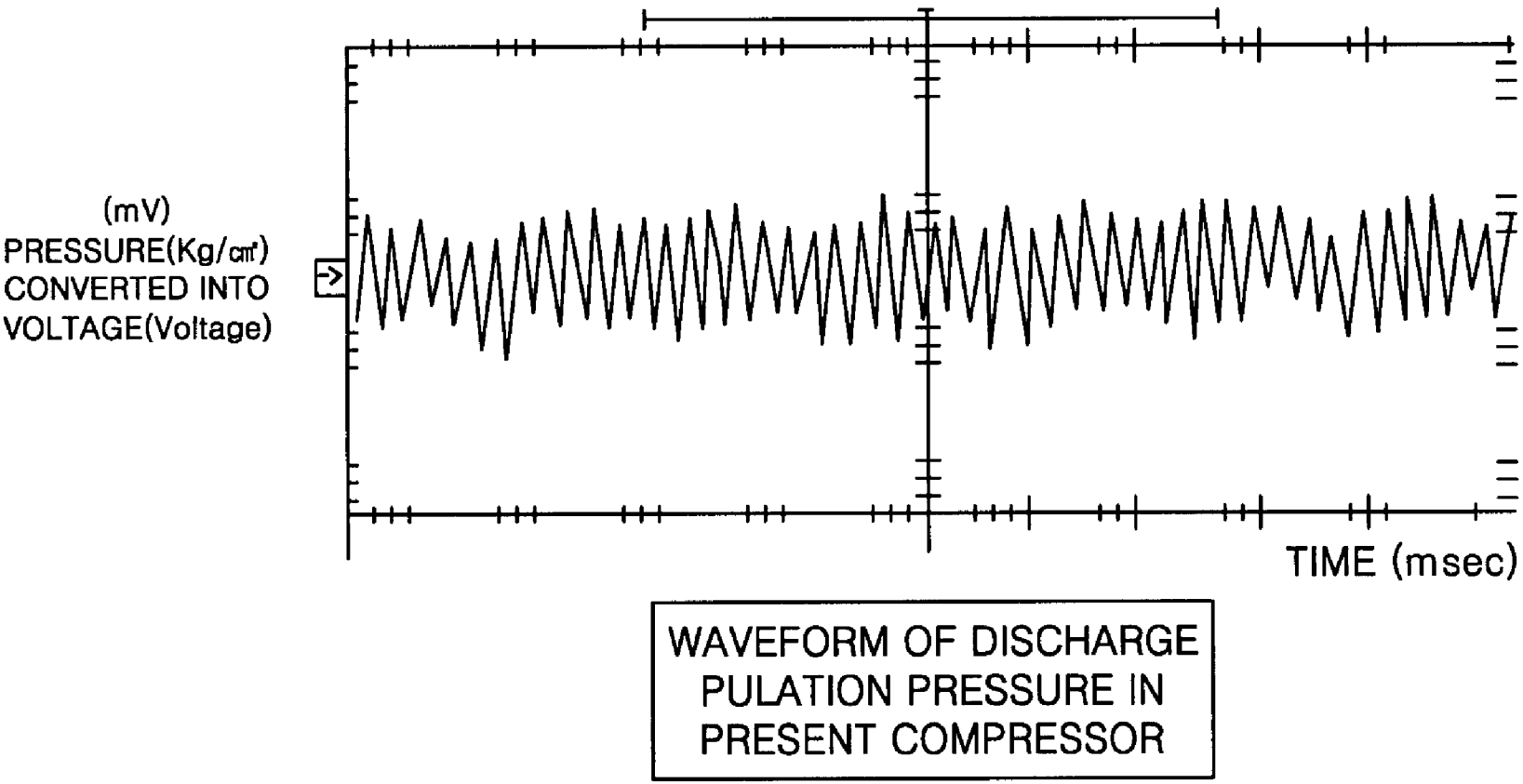
FIG. 5B is a graph showing the waveforms of pressure pulsation of refrigerant discharged in the compressor according to the present invention.

On the other hand, in the present invention, as shown in FIG. 5B, distances L between the respective discharge holes 43 and the inlet 49 of the pulsation pressure reduction conduit 48 are substantially equal to one another. The distance L in the compressor according to the present invention is relatively smaller than the maximum distance in the conventional compressor. Thus, the overall amplitude of the discharge pressure pulsation in the present invention is smaller than that of the conventional discharge pulsation, thereby substantially reducing pressure pulsation of the discharged gas.

The inlet 49 of the pulsation pressure reduction conduit 48 may be provided at a position at which the pulsation pressure of the discharged gas at each of the discharge holes 43 is substantially the same as that of the discharged gas at the inlet 49 of the pulsation pressure reduction conduit 48.

Even when the distances between the respective discharge holes 43 and the inlet 49 of the pulsation pressure reduction conduit 48 are substantially equal to one another, pulsation pressures of the discharged gas at the inlet of the pulsation pressure reduction conduit 48 may be different depending on the relative positions of the respective discharge holes 43, and the overall configuration of the discharge chamber 26 or the area of a space occupied by the pulsation pressure reduction conduit 48 inside the discharge chamber 26. In this case, the position of the inlet 49 of the pulsation pressure reduction conduit 48 can be determined by the pulsation pressure of discharge gas at the inlet 49 of the pulsation pressure reduction conduit 48. Also, the position of the inlet 49 of the pulsation pressure reduction conduit 48 can be determined by one skilled in the art in an experimental manner.

Further, according to this embodiment of the present invention, as shown in FIG. 3, a cross-sectional area A1 of the inlet 49 of the pulsation pressure reduction conduit 48 is determined by a cross-sectional area A2 of a passageway 50 of the pulsation pressure reduction conduit 48 such that the pulsation pressure of the discharged gas at the passageway 50 of the pulsation pressure reduction conduit is smaller than the pulsation pressure of the discharged gas at the inlet 49 of the pulsation pressure reduction conduit 48. Preferably, the cross-sectional area A1 of the inlet 49 of the pulsation pressure reduction conduit 48 is smaller than the cross-sectional area A2 of a passageway 50 of the pulsation pressure reduction conduit 48.

In such a manner, the discharged gas passing through the inlet 49 of the pulsation pressure reduction conduit 48 is moved to the passageway 50 of the pulsation pressure reduction conduit 48 having a larger cross-sectional area than the inlet 49 of the pulsation pressure reduction conduit 48, thereby reducing the pressure pulsation of the discharged gas.

Thus, the pressure pulsation of the discharged gas, which is once reduced at the inlet of the pulsation pressure reduction conduit 48, is further reduced at the passageway 50 of the pulsation pressure reduction conduit 48.

In an aspect of the present invention, a suction muffler chamber 40 connected to an external refrigerant circuit through the suction port 40 is formed on the outer circumferential surface of the cylinder 21. A lid 41 facing an opening end of the suction muffler chamber 40 is formed on the outer circumferential surface of the rear housing 25 and coupled to the edge of the opening end of the suction muffler chamber 40, closing the suction muffler chamber 40.

Thus, it is not necessary to form a separate lid member in the suction muffler chamber 40, thereby facilitating formation of the suction muffler chamber 40.

As shown in FIG. 4, the lid 41 includes one or more suction chamber connecting passages 41*a* connecting the suction muffler chamber 40 with the suction chamber 27 of the rear housing 25 so that the refrigerant gas of the suction muffler chamber 40 is induced to the suction chamber 27. Here, two suction chamber connecting passages 41*a* are formed at the lid 41, as shown in FIG. 4.

By forming the suction chamber connecting passages 41*a*, the refrigerant gas of the suction muffler chamber 40 can flow smoothly to the suction chamber 27 of the rear housing 25, thereby considerably reducing a pressure drop in the refrigerant gas.

The operation of the compressor according to the present invention will now be described.

The refrigerant gas sucked from the external refrigerant circuit to the suction muffler chamber 40 through the suction port 42 is moved to the suction chamber 27 of the rear housing 25 through the suction chamber connecting passage 41*a*, compressed by the single-headed piston 36 and the driving shaft 28, and then sent to the crank chamber 22 having the cylinder 21 and the front housing 23 through the suction holes 44, and discharged to the discharge chamber 26 of the rear housing 25 through the discharge holes 43. Then, the discharged refrigerant gas is induced to the pulsation pressure reduction conduit 48 through the inlet 49 of the pulsation pressure reduction conduit 48 and discharged to the external refrigerant circuit via the passageway 50.

The compressor according to the present invention has the following advantages.

Pressure pulsation of discharged gas and noise due to the pressure pulsation can be reduced while maintaining the overall volume of the compressor, reducing a pressure drop in compressed refrigerant discharged from the compressor and maintaining a space occupied by a discharge chamber inside a rear housing of the compressor.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A compressor, which is configured to suck refrigerant gas from an external refrigerant circuit, compress the sucked refrigerant gas and discharge the compressed refrigerant gas, said compressor comprising:

a cylinder having a plurality of bores;

a front housing being coupled to a front side of the cylinder and forming a crank chamber;

a driving shaft supported to be freely rotatable with respect to the cylinder and the front housing;

a slanting plate element mounted on the driving shaft;

a single-headed piston connected to said slanting plate element for linearly reciprocable displacement within one of the bores of the cylinder; and a rear housing being coupled to and closing a rear side of the cylinder, wherein the rear housing comprises:

a discharge chamber provided at the center of the interior of the rear housing, so that the refrigerant gas discharged from the cylinder through a plurality of discharge holes remains in the discharge chamber before being discharged to the external refrigerant circuit;

a suction chamber surrounding the discharge chamber, so that the refrigerant gas sucked from the external refrigerant circuit remains in the suction chamber before being moved to the cylinder; and a pulsation pressure reduction conduit provided at a rear side of the rear housing, said conduit having a single inlet led to the discharge chamber and an outlet led to the external refrigerant circuit, and said conduit extending in a radial direction of the rear housing, wherein the single inlet of the pulsation pressure reduction conduit through which the discharged gas of the discharge chamber passes is positioned at a position at which the pressure pulsations of the discharged gas at the respective discharge holes are substantially equal, said position of said single inlet depending on relative positions of the discharge holes in the discharge chamber, an overall configuration of the discharge chamber, and a volume of space occupied by the pulsation pressure reduction conduit in the discharge chamber.

2. The compressor of claim 1, wherein the inlet of the pulsation pressure reduction conduit is, equally spaced from the discharge holes through which the gas discharged from the cylinder to the discharge chamber passes.

3. The compressor of claim 1, wherein the inlet of the pulsation pressure reduction conduit is positioned at the center of the discharge chamber.

4. The compressor of claim 1, wherein a cross-sectional area of the inlet of the pulsation pressure reduction conduit and a cross-sectional area of a passageway of the pulsation pressure reduction conduit are sized such that the pulsation pressure of the discharged gas in the passageway of the pulsation pressure reduction conduit is smaller than the pulsation pressure of the discharged gas at the inlet of the pulsation pressure reduction conduit.

5. The compressor of claim 4, wherein the cross-sectional area of the inlet of the pulsation pressure reduction conduit is smaller than the cross-sectional area of the passageway of the pulsation pressure reduction conduit.

* * * * *